US010981036B2

(12) United States Patent
Marsland

(10) Patent No.: US 10,981,036 B2
(45) Date of Patent: Apr. 20, 2021

(54) VARIABLE AQUATIC TRAINING AID

(71) Applicant: Harrison Marsland, King City (CA)

(72) Inventor: Harrison Marsland, King City (CA)

( * ) Notice: Subject to any disclaimer, the term of this patent is extended or adjusted under 35 U.S.C. 154(b) by 0 days.

(21) Appl. No.: 16/720,095

(22) Filed: Dec. 19, 2019

(65) Prior Publication Data

US 2020/0368584 A1 Nov. 26, 2020

Related U.S. Application Data

(60) Provisional application No. 62/852,287, filed on May 23, 2019.

(51) Int. Cl.

| | |
|---|---|
| ***A63B 31/00*** | (2006.01) |
| ***A63B 31/14*** | (2006.01) |
| ***A63B 31/12*** | (2006.01) |
| ***A63B 31/11*** | (2006.01) |

(52) U.S. Cl.

CPC ..... *A63B 31/14* (2013.01); *A63B 31/11* (2013.01); *A63B 31/12* (2013.01)

(58) Field of Classification Search

CPC ..... A63B 31/00; A63B 31/04; A63B 31/08; A63B 31/10; A63B 31/11; A63B 31/12; A63B 31/14; A63B 31/18

USPC ..... 441/55–64

See application file for complete search history.

(56) References Cited

U.S. PATENT DOCUMENTS

| | | | | |
|---|---|---|---|---|
| 3,055,025 A * | 9/1962 | Ferraro | A63B 31/11 | 441/64 |
| 3,183,529 A * | 5/1965 | Beuchat | A63B 31/11 | 441/64 |
| 3,422,470 A * | 1/1969 | Lodovico | A63B 31/11 | 441/64 |
| 3,908,213 A * | 9/1975 | Hill | A63B 31/11 | 441/64 |
| 4,627,820 A * | 12/1986 | Penebre | A63B 31/11 | 441/64 |
| 4,948,385 A * | 8/1990 | Hall | A63B 31/11 | 441/61 |
| 5,108,328 A * | 4/1992 | Hull | A63B 31/11 | 441/61 |
| 5,709,575 A * | 1/1998 | Betrock | A63B 31/11 | 441/64 |
| 5,746,631 A * | 5/1998 | McCarthy | A63B 31/11 | 441/64 |
| 6,354,894 B1 * | 3/2002 | Evans | A63B 31/11 | 441/64 |
| 7,753,749 B2 * | 7/2010 | Mun | A63B 31/11 | 441/64 |

* cited by examiner

*Primary Examiner* — Daniel V Venne

(74) *Attorney, Agent, or Firm* — Dickinson Wright LLP; Yuri Chumak

(57) ABSTRACT

An aquatic training aid includes a paddle member for wearing by a swimmer, a variable diaphragm disposed within the paddle member, the variable diaphragm including a plurality of fitted blades arranged to form an aperture, and a housing peripherally framing the plurality of fitted blades. The variable diaphragm is adjustable to change the aperture from a first expanded position to a second contracted position, and hydrodynamic characteristics of the aquatic training aid when moved through water are affected by the change of the aperture. Controlling the aperture enables the swimmer to adjust the resistance provided by the aquatic training aid when it is moved through water.

12 Claims, 13 Drawing Sheets

VARIABLE AQUATIC TRAINING AID

FIELD OF TECHNOLOGY

The present specification is directed to sport accessories, and more particularly, to aquatic training aids.

BACKGROUND

Various types of restraints, weights and the like are used in training and development of competitive swimmers and water sport participants as well as athletes, surfers, medical rehabilitation patients, and others.

Aquatic training aids, such as hand-held swim paddles, are used for improving a swimmer's technique, efficiency and for increasing muscle strength. Training with the paddles enables a swimmer to strengthen body movement through the water. With use over time, the swimmer is able to swim faster, with proper technique, and for longer periods of time than without the training aid.

Training aids capable of providing a variety of resistance levels are desirable. Current solutions require swimmers to wear paddles of different sizes and shapes in order to provide a range of resistance levels according to skill level, swimming style and intended use of the swimmer (generally speaking, the larger the paddle size, the higher the level of difficulty). One drawback with current approaches is that the swimmer must change paddles to vary the resistance during a swim session.

Current solutions do not allow swimmers to conveniently adjust resistance levels.

A need exists for improved devices and aids that provide variable aquatic training resistance. Improvements in or alternatives to current aquatic training aids are desirable.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings.

DETAILED DESCRIPTION

Representative devices according to the present application are described in this section. These examples are being provided solely to add context and aid in the understanding of the described embodiments. It will thus be apparent to one skilled in the art that the described embodiments may be practiced without some or all these specific details. In other instances, well-known features have not been described in detail to avoid unnecessarily obscuring the described embodiments. The following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the scope of the described embodiments.

The disclosed examples of the present specification contemplate an aquatic training aid including a paddle member for wearing by a swimmer, a variable diaphragm (also referred to as an iris or circular diaphragm) disposed within the paddle member, the variable diaphragm including a plurality of fitted blades arranged to form an aperture, and a housing peripherally framing the plurality of fitted blades. The variable diaphragm is adjustable to change the aperture from a first expanded position to a second contracted position, and hydrodynamic characteristics of the aquatic training aid when moved through water are affected by the change of the aperture.

Advantageously, the aperture can be variably expanded and contracted so as to adjust the effective surface area of the aquatic training aid thereby altering the hydrodynamic characteristics of the aquatic training aid including the thrust force as the swimmer pulls the water with his or her hands. Changing the aperture changes the characteristics of how the aquatic training aid handles in the water. Similar to using weights at the gym, having a device that allows swimmers to variably change the thrust force and drag experienced through the water and this replaces the need for having many different sizes of equipment.

Figure 1:
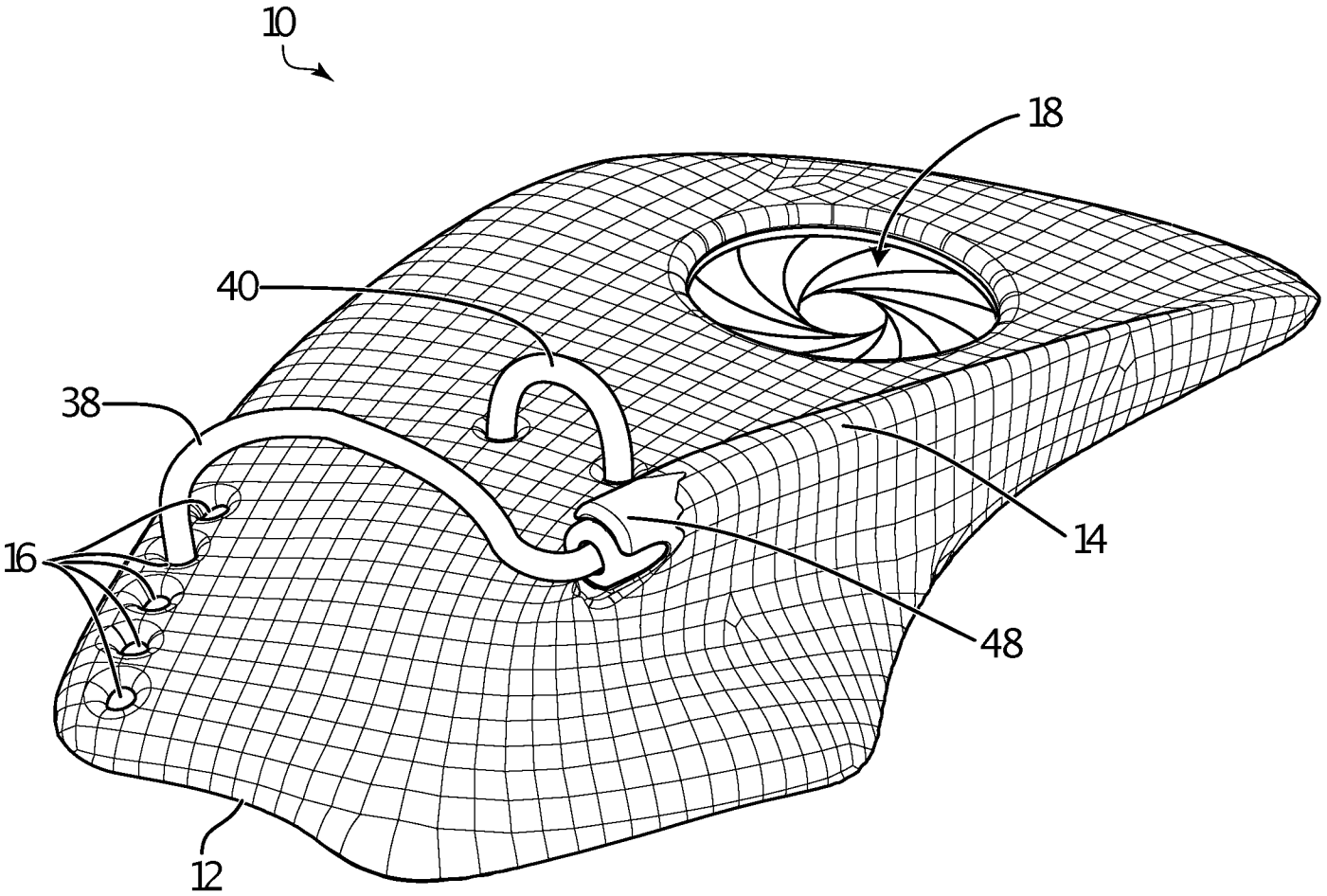
FIG. 1 is a perspective view of an aquatic training aid in accordance with an example.
Figure 2:
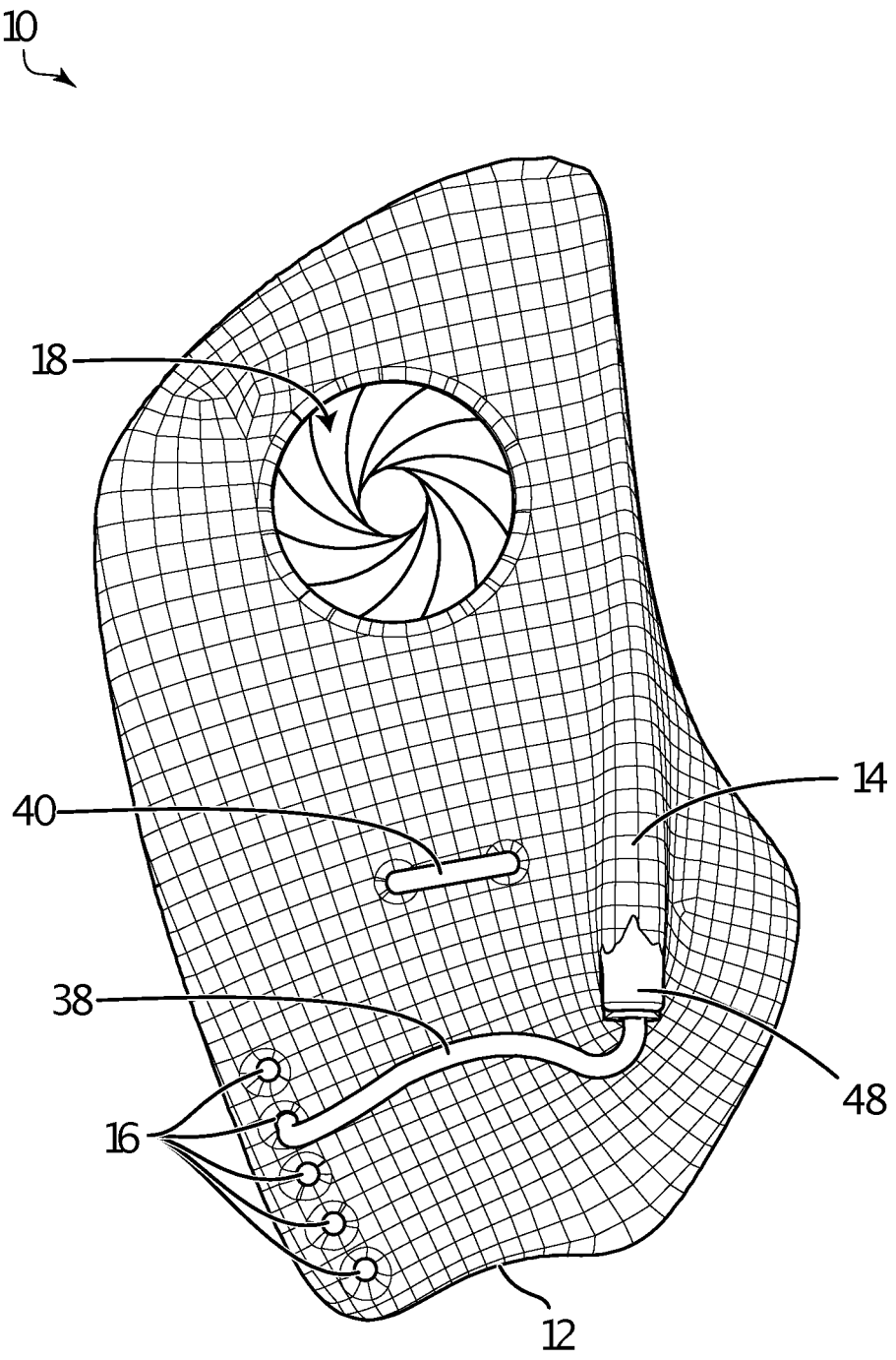
FIG. 2 is a top plan view of the aquatic training aid of FIG. 1.
Figure 3:
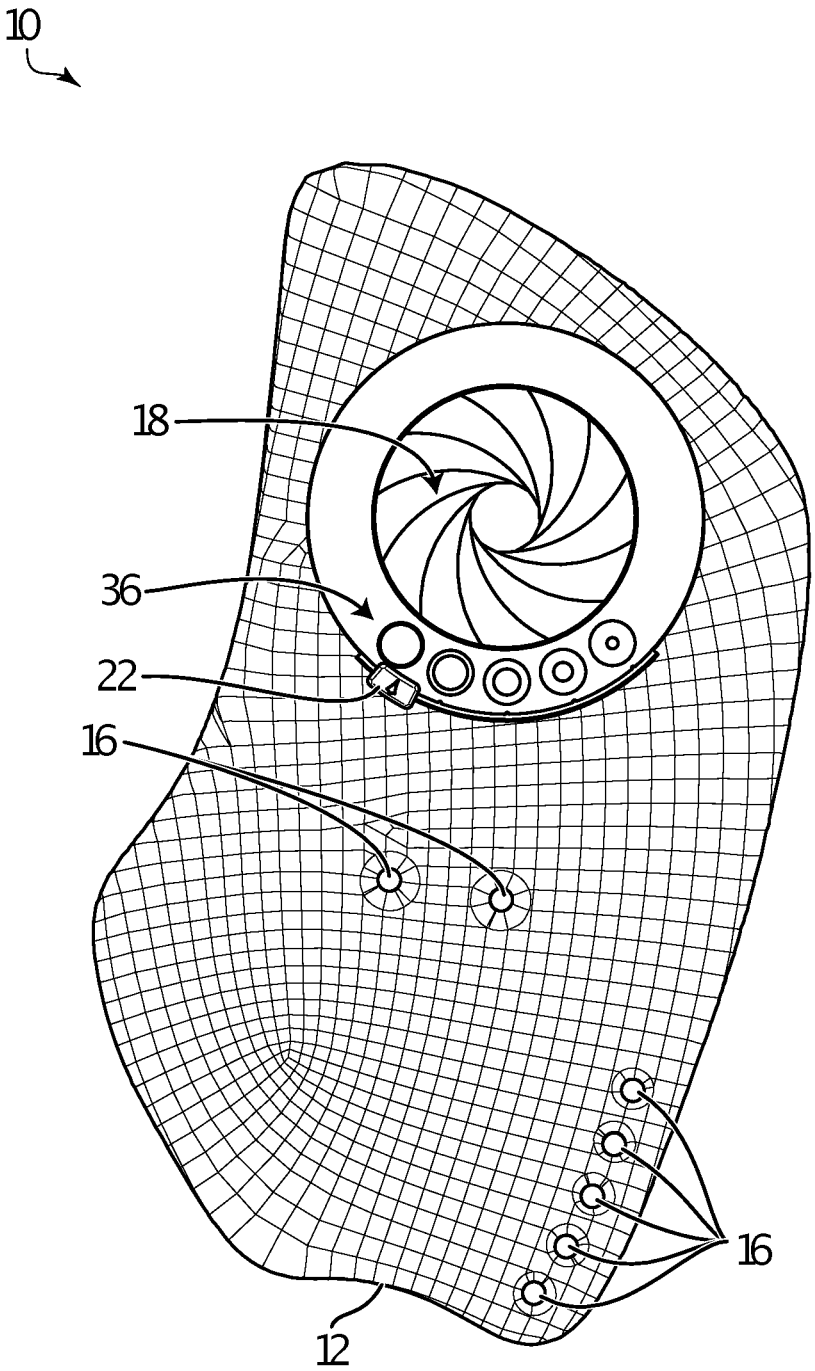
FIG. 3 is a bottom plan view of the aquatic training aid of FIG. 1.

According to one example, with reference to FIG. 1, FIG. 2 and FIG. 3, an aquatic training aid 10 includes a paddle body 12 with a variable diaphragm 18, a contoured ridge 14 terminating at a snap connector 48, a hand strap 38 and a finger strap 40 made of tubular string secured to the paddle body 12 at one of recesses 16 at both ends (or at one end and the snap connector 48 at the other end in the case of the hand strap 38). The swimmer's hand rests flat against the paddle body 12 and is held in place by the hand strap 38, which fits across the metacarpal-portion of the swimmer's hand, and the finger strap 40 which fits across one or both of the swimmer's index and middle fingers. In this example, the paddle body 12 is shaped to conform to the natural position of the hand. The recesses 16 allow the hand strap 38 to be secured in various configurations to the paddle body 12 enabling it to receive hands of a variety of shapes and sizes. In the present specification, use of the term diaphragm extends to any device for varying the effective aperture or variable opening in an aquatic training aid.

Materials for manufacture of the paddle body 12 can include ethylene-vinyl acetate (EVA), foams, plastics, injection or compression molded rubber, or any other material promoting a desirable degree of flotation and/or rigidity. In one example, the paddle body 12 can be made from a higher density foam to highlight the form. In yet other examples, the paddle body 12 can be made from a rigid urethane foam cast in a silicone mold or can be made using plastic injection molding. FIG. 3 shows the size indicator 36 and an actuator slider 22 (also referred to as a protruding slider) that permits selection of the size of the aperture of the variable diaphragm 18.

An aquatic training aid 10 with a closed aperture of the variable diaphragm 18 has the largest effective surface area and therefore imparts the highest amount of form drag in the water. Swimmers using the aquatic training aid 10 when the aperture of the variable diaphragm 18 is closed experience the highest level of aquatic resistance and therefore have a lower stroke rate as compared to swimming without the aquatic training aid at all. When the aperture of the variable diaphragm 18 is open, the resistance experienced is less than when completely closed. Swimmers generally take more strokes when swimming with an open aperture of the variable diaphragm 18.

Figure 4:
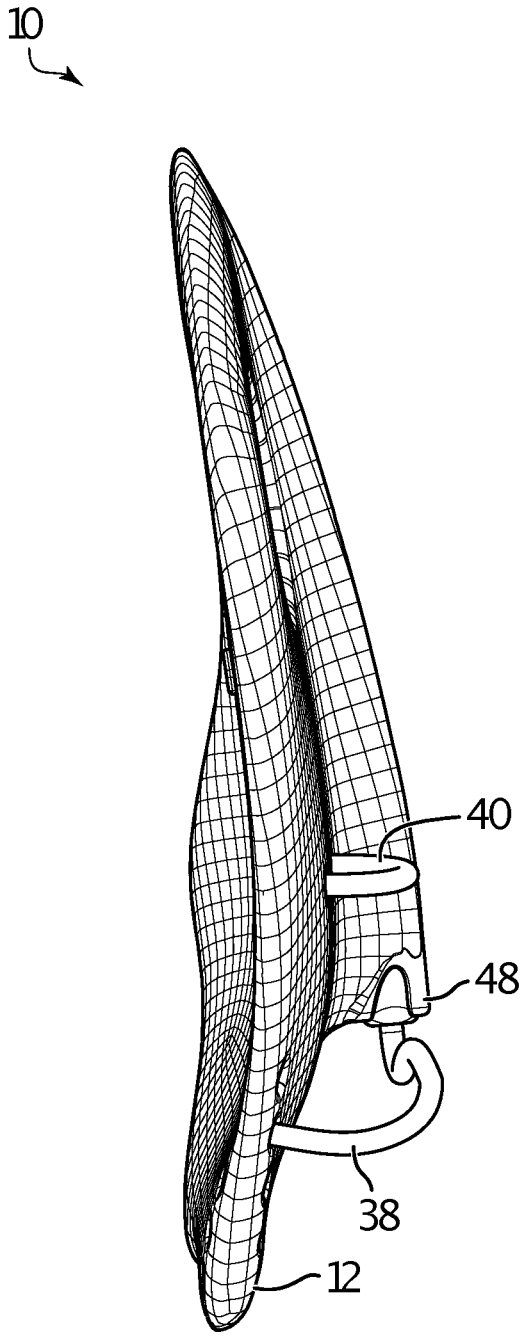
FIG. 4 is a left side view of the aquatic training aid of FIG. 1.
Figure 5:
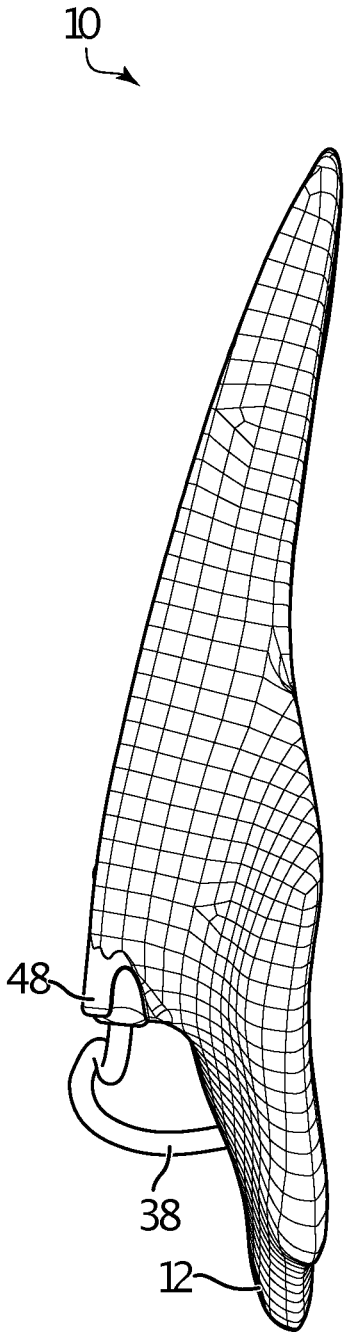
FIG. 5 is a right side view of the aquatic training aid of FIG. 1.

As shown in FIG. 4 and FIG. 5, the paddle body 12 can be curved away from the palm of the swimmer's hand increasing the effective surface area of the aquatic training aid 10, allowing the swimmer to pull more water to propel themselves forward. In the examples illustrated in FIG. 4 and FIG. 5, the aquatic training aid 10 and the paddle body 12 is formed for a swimmer's left hand. A mirror image of the aquatic training aid 10 for the swimmer's right hand is not shown.

To accommodate as many hand sizes as possible the aquatic training aids 10 can provide options for securing or mounting the hand strap 38 and the finger strap 40. For example, the hand strap 38 can be weaved or stringed through the recesses 16 (also referred to as holes or eyelets) that secure the hand strap 38 in place.

The contoured ridge 14 can enable water to flow smoothly over the top surface of the aquatic training aid 10. As shown in FIG. 5, the snap connector 48 terminates at the distal end of the contoured ridge 14 adjacent to the finger strap 40. Turbulent flow that may otherwise be introduced by the swimmer's hand is minimized by the aerodynamic contours of the contoured ridge 14 and the curvature of the paddle body 12 itself.

Figure 6:
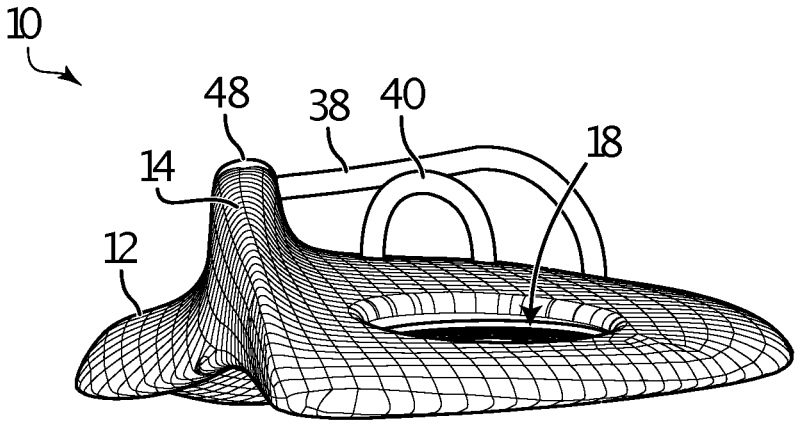
FIG. 6 is a front view of the aquatic training aid of FIG. 1.

The precise curvature and topography of the contoured ridge 14 has been the subject of extensive testing. FIG. 6 shows one example of the contoured ridge 14 and the snap connector 48 at its distal end. Other curvatures and topographies are intended to be within the scope of the present specification.

Figure 7:
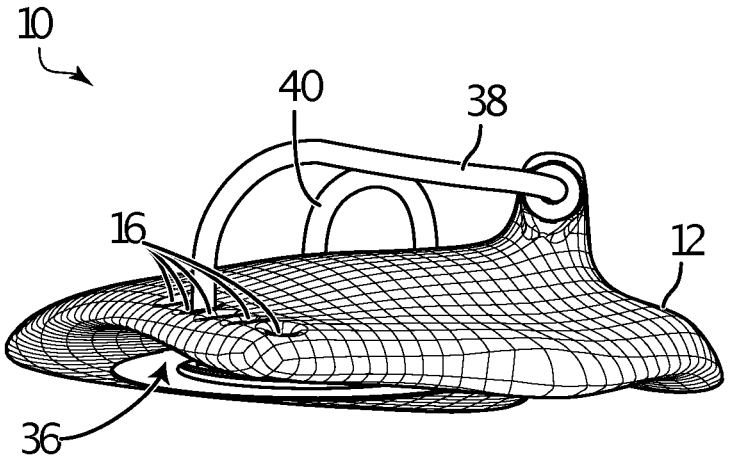
FIG. 7 is a rear view of the aquatic training aid of FIG. 1.

Similarly, FIG. 7 shows the contoured ridge 14 from the rear. The snap connector 48 is also shown in FIG. 7. The snap connector 48 can be made from light but rigid material that can be molded such as polyurethane resin cast in a silicone mold or using plastic injection molding. The hand strap 38 can be made of a light, soft and flexible material with a friction coefficient that will enable it to mate effectively with the snap connector 48 such as latex surgical tubing. The snap connector 48 and hand strap 38 enable the aquatic training aid 10 to accommodate hands of many different sizes and shapes.

Figure 8:
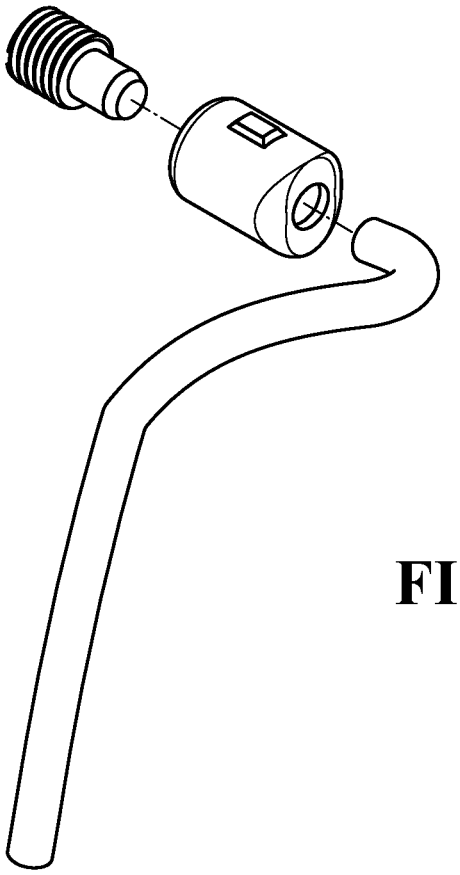
FIG. 8 is a perspective view of a snap connector in accordance with an example.

FIG. 8 is an exploded view of a snap connector 48 in accordance with an example showing the snap connector 48 as it connects to the hand strap 38. Due to the harsh chemical environment often found in indoor swimming pools, latex rubber tubing can degrade over time. For this reason, a removable snap fitting plug was incorporated in this example to allow the hand strap 38 to be replaced if it breaks. The snap connector 48 design shown here provides a convenient way of quickly interchanging components of the aquatic training aid 10. The snap connector 48 can be made from light but rigid material that can be molded such as polyurethane resin cast in a silicone mold or using plastic injection molding.

Alternatives to the snap connector 48 are within the scope of the present specification. Fasteners such as threaded screws or button-strap connectors can also be used if a robust material capable of withstanding harsh chemical environments is desired for the hand strap 38. Configurations that do not require a snap connector 48 at all, such as weaving the hand strap 38 through recesses 16 on the aquatic training aid 10 without the need for a snap connector 48 are also possible though not shown in the drawings.

Figure 9:
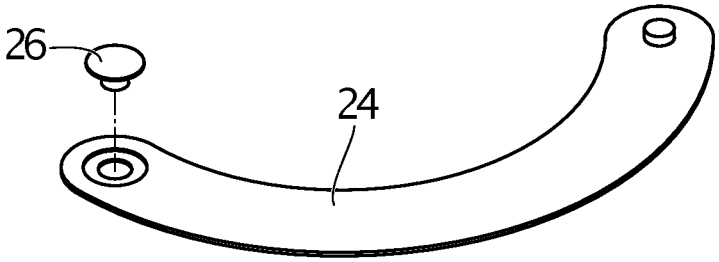
FIG. 9 is a perspective view of a blade and pivot pin in accordance with an example.

FIG. 9 depicts an exploded view of a single blade 24 (collectively blades 24) and pivot pin 26. The blades 24 can be made from a rigid, light, and smooth material with a low coefficient of friction at its surface to enable smooth sliding action when the variable diaphragm 18 is actuated. Rigid materials can be used such as fiber composites or any material strong enough to provide structural support and withstand the pressure force of the water.

Figure 10A:
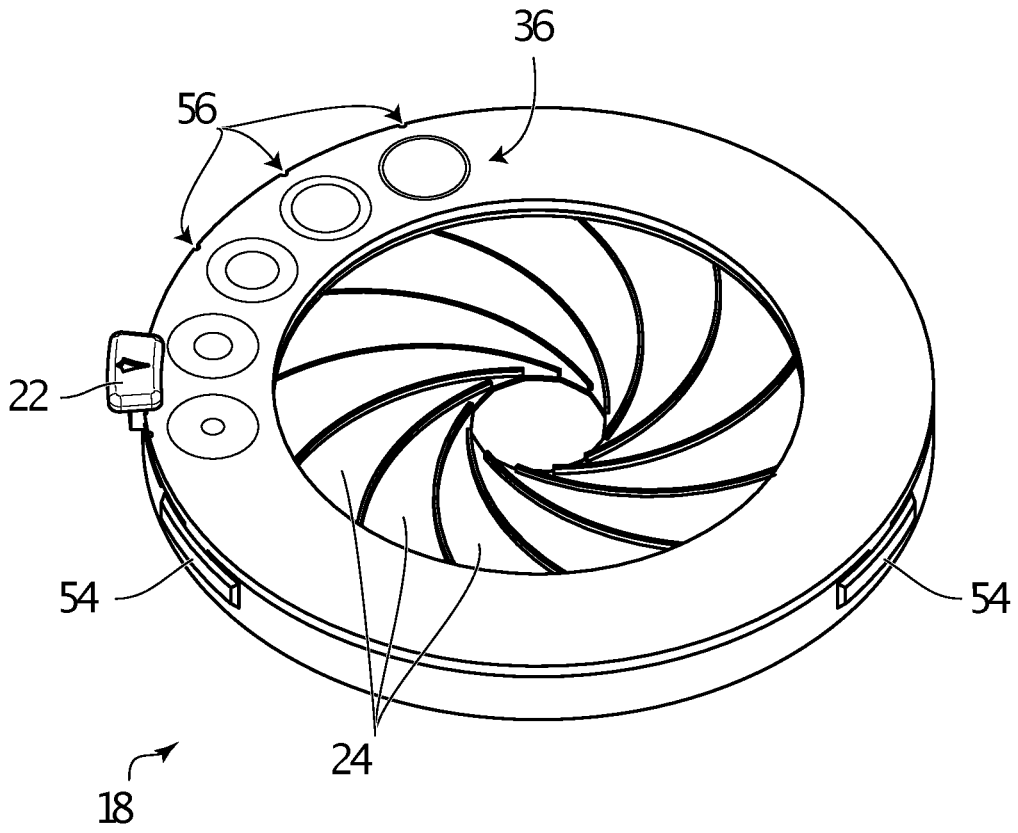
FIG. 10A is a perspective view of a variable diaphragm in accordance with an example.
Figure 10B:
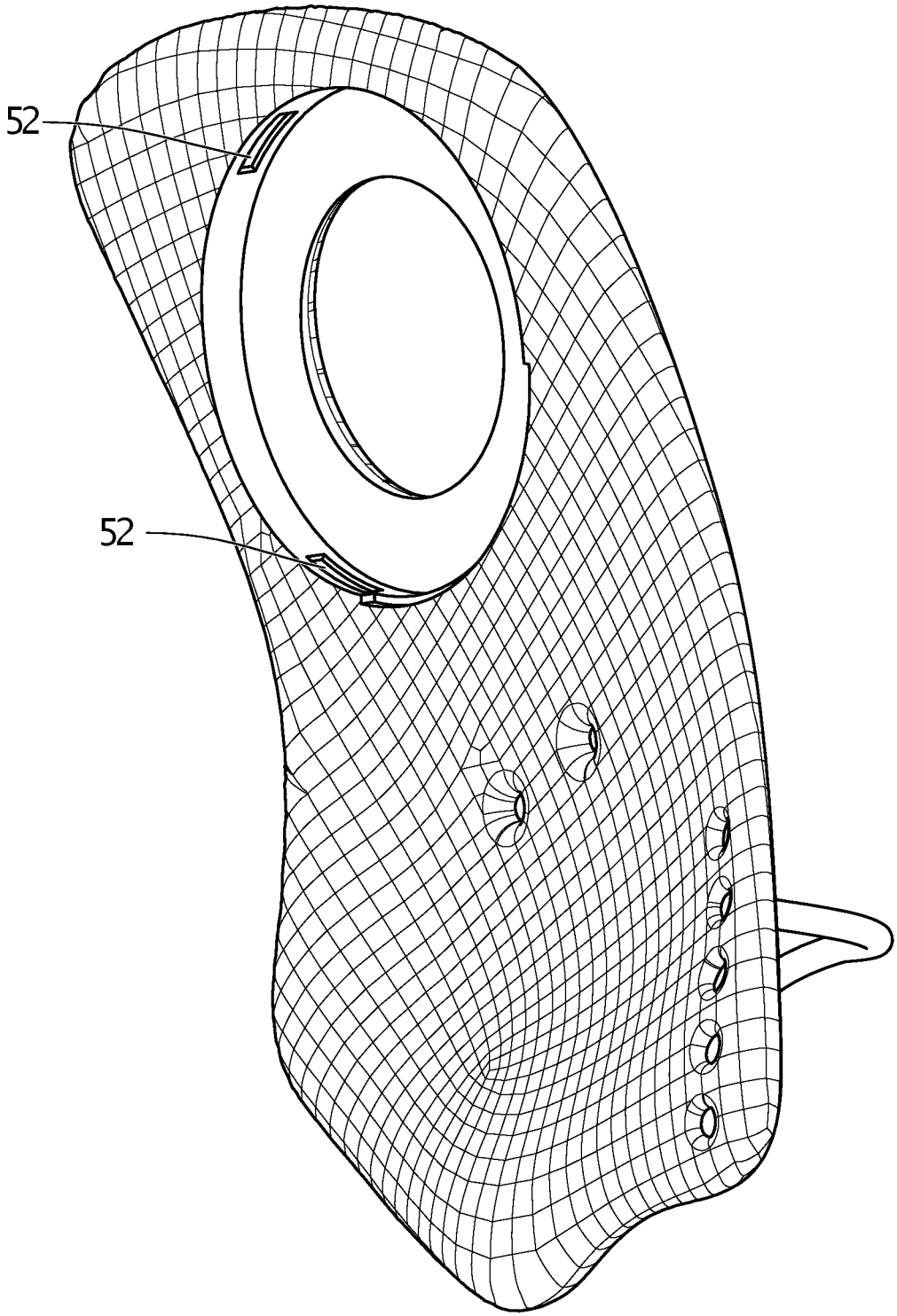
FIG. 10B is a perspective view of the aquatic training aid of FIG. 1, with the variable diaphragm removed.

According to one exemplary design, the variable diaphragm 18 shown in FIG. 10A can be removed from the paddle body 12 shown in FIG. 10B for cleaning or replacement or to exchange for another variable diaphragm 18 having the same or different properties. For example, a variable diaphragm 18 having many thinner blades 24 would provide alternative control and variability compared to a variable diaphragm having fewer thicker blades 24.

The number of blades 24 varies depending on the amount of resistance variability desired. In one example, the number of blades 24 can range from 6 to 20 or more. The dimension of the blades 24 themselves varies according to the number of blades 24 required. It is noted that the maximum number of blades 24 is limited by the internal height of the top plate 28 and the base plate 30 when fitted together. Similarly, there is a lower limit to the number of blades 24 to ensure effective closing of the iris resulting in no space to allow air, water and other materials to pass through the diaphragm when the aperture is closed. In this regard, the minimum number of blades 24 required to form a closed aperture and the maximum number required to achieve the desired level of aperture variability is to be considered when selecting the internal height created by the inner surfaces of the top plate 28 and the base plate 30.

Figure 11A:
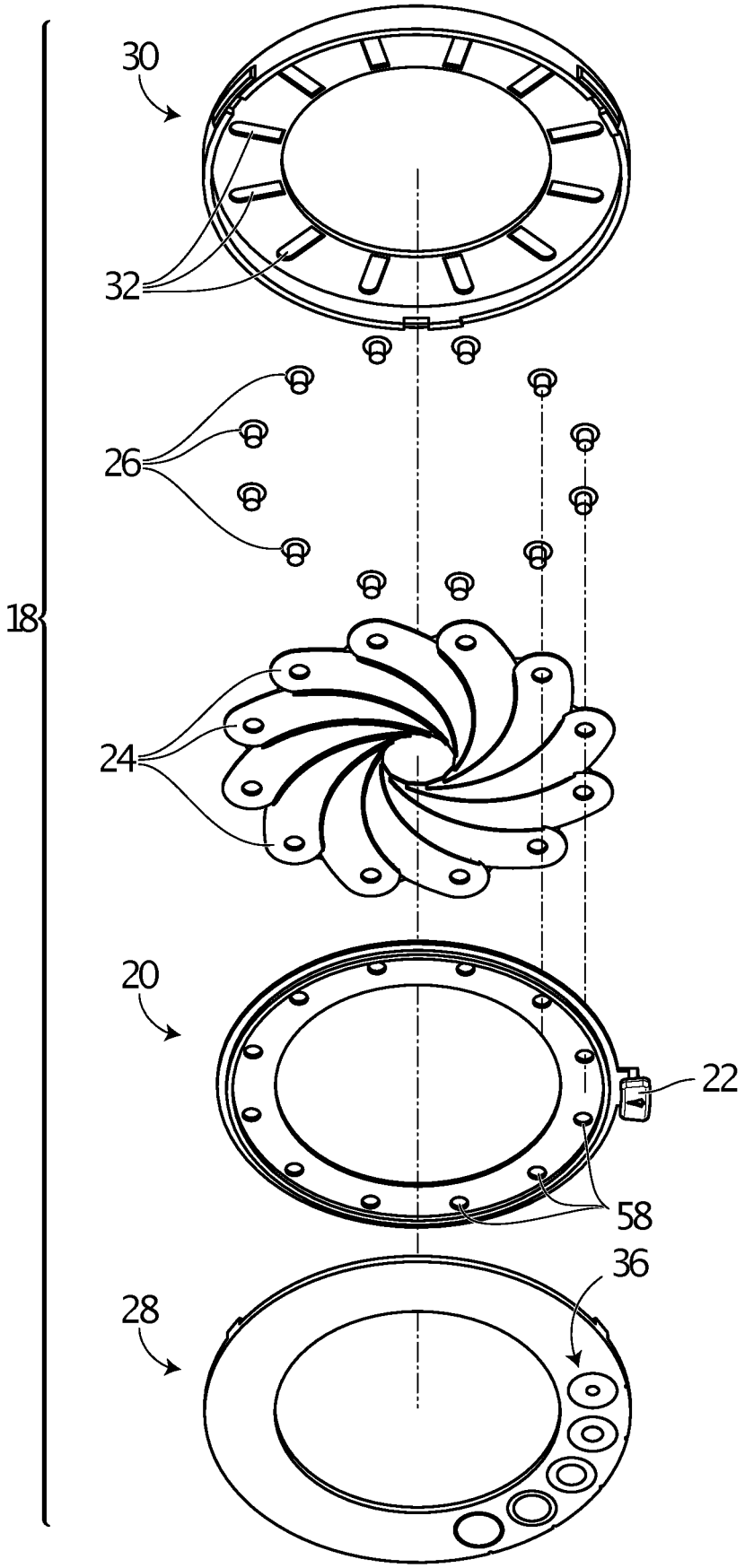
FIG. 11A and FIG. 11B are bottom and top perspective views, respectively, of a variable diaphragm in accordance with an example.

Referring to FIG. 11A, the variable diaphragm 18 includes a plurality of blades 24 arranged in a circle within a housing. The housing is made up of a top plate 28, a base plate 30, and an actuator 20 (also referred to as a blade actuating ring), contained within the top plate 28 and the base plate 30. The blades 24 can be crescent-shaped to have a good fit in a variable diaphragm 18 that is circular. The blades 24 have protrusions or pins on opposite surfaces of the blades 24 that mate with portions of the actuator 20 and the base plate 30. The base plate 30 includes a circular ring with longitudinal slots 32 that are inset and extend radially correlating to the number of blades 24 of the variable diaphragm 18. The blades 24 are arranged within the base plate 30 and oriented such that the pins at one end of the blades 24 (not shown in FIG. 11A) of each blade 24 travel inside the longitudinal slots 32. Pivot pins 26 at the opposite end of the blades 24 fit through evenly spaced openings 58 of the actuator 20. The blades 24 may be positioned to overlap with each other such that a complete ring is formed. The actuator 20 can be press-fit between the top plate 28 and the base plate 30 and is free to rotate within the plates. A swimmer can rotate the actuator 20 via sliding movement of the actuator slider 22 which can be positioned below the top plate 28. In use, as the actuator 20 is rotated relative to the top plate 28 and the base plate 30, the blades 24 rotate and stack on top of each other and enable closure of the aperture. Through articulation, the blades 24 achieve expansion and contraction of the central aperture of the variable diaphragm 18.

In one example, and as shown in FIG. 10A, the top plate 28 may have a size indicator 36 (also referred to as a legend) embossed on its outer surface. The size indicator 36 serves as a pictorial representation of the size of the aperture of the variable diaphragm 18 when the actuator 20 is in a particular orientation as indicated by the position of the actuator slider 22. According to this example, the actuator slider 22 fits through an opening of the top plate 28 and slides along the bottom surface of the top plate 28.

The size indicator 36 can be positioned to show aperture sizes ordered from an expanded position to a contracted position with one or more (e.g., three or more) intermediate positions. The actuator slider 22 is aligned with the size indicator 36 to allow selection of resistance level by sliding movement of the actuator slider 22. Notches 56 can be formed in the top plate 28 demarcating the various positions and, in one example, the actuator slider 22 stops and enters the notches 56 during sliding engagement and/or rotation.

Figure 11B:
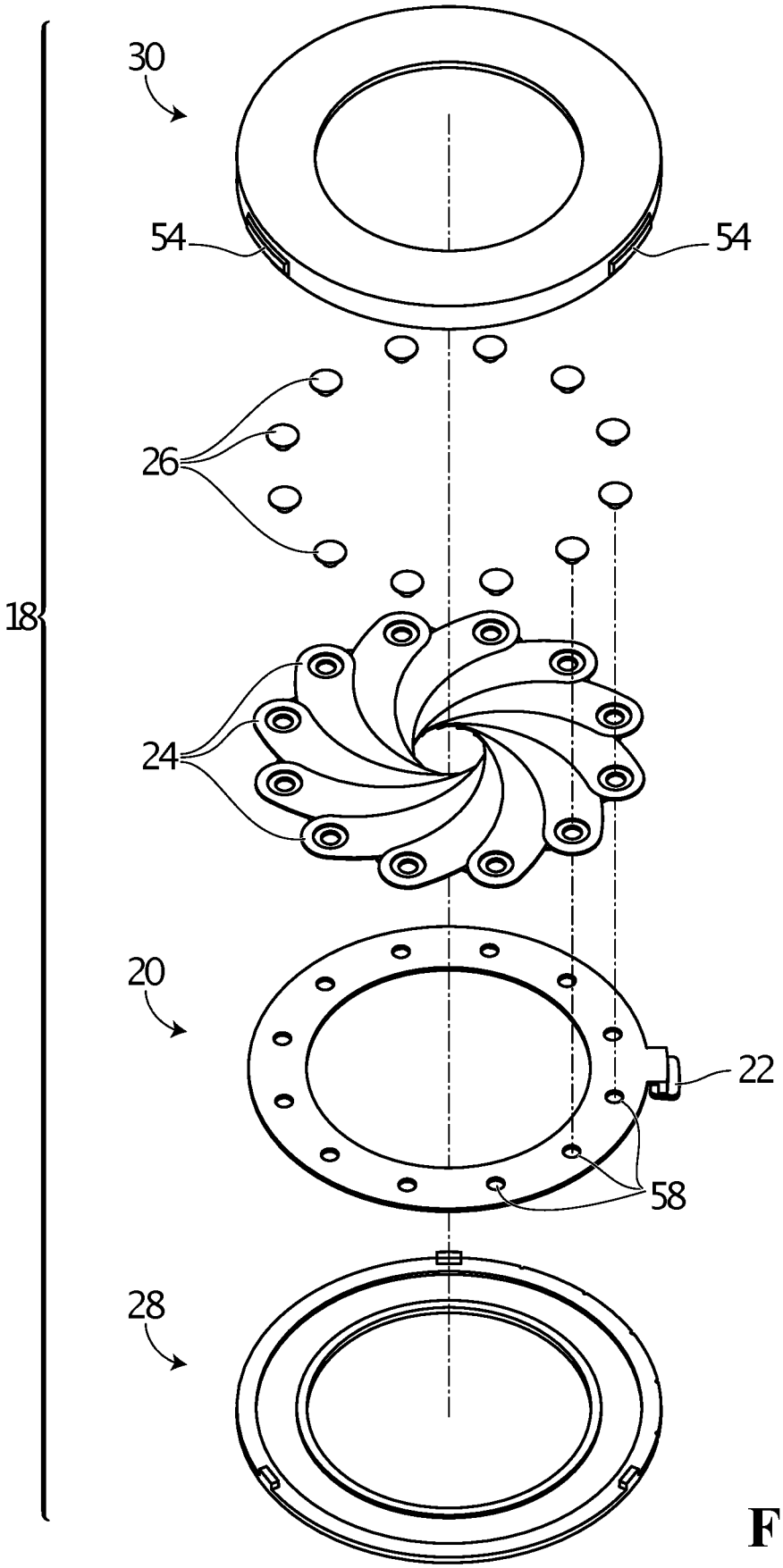

As shown in FIG. 11B, locking slots 54 enable the variable diaphragm 18 to be secured to openings 52 in the paddle body 12 (the openings 52 are shown in FIG. 10B). According to some examples, the top plate 28, the base plate 30, and the actuator 20 can be made from polyurethane resin cast in a silicone mold or can be made using plastic injection molding. The material used can be rigid and light and moldable to enable a precise fit with the other components.

The blades 24 can be of various thicknesses and may be formed with more ridged plastics, fiber composites or any material strong enough to provide structural support and the pressure force of the water. The thickness of the blades 24 contribute to the step-wise resolution of the expansion and contraction of the aperture and the resistance experienced by the swimmer as they actuate the variable diaphragm 18.

In general, the thickness of the blades 24 will determine the number of blades 24 that can be contained within the upper 30 and lower 28 housing. Controlling for the size of the upper 30 and lower 28 housing, a variable diaphragm 18 will be able to house a high number of thin blades 24 and a lower number of thick blades 24.

In terms of step-wise resolution, a variable diaphragm 18 including many thin blades 24 will generally result in a higher resolution (i.e., smaller intervals of movement) in the expansion and contraction of the aperture than a variable diaphragm 18 including fewer thick blades 24 when in use. The friction experienced by the swimmer during actuation (i.e., the resistance that one blade 24 surface encounters when moving over another) would be expected to be greater for a variable diaphragm 18 consisting of fewer thick blades 24 than a variable diaphragm 18 consisting of many thin blades 24. number of blades determines the width of the variable diaphragm. A lower number of blades 24 makes the "donut" of the variable diaphragm 18 thinner reducing the amount of "dead space" for the blades 24 to overlap on. The step-wise resolution would be determined by the just noticeable difference in opening and closing of the actuator 20. If the aperture was larger, then more increments could be added.

When assembled, the aquatic training aid 10 acts as an extension of the swimmer's body. The actuator slider 22 provides a convenient interface for the swimmer to change the aperture by actuating the variable diaphragm 18. Advantageously, the actuator slider 22 can be engaged without taking off the aquatic training aid 10.

Figure 12:
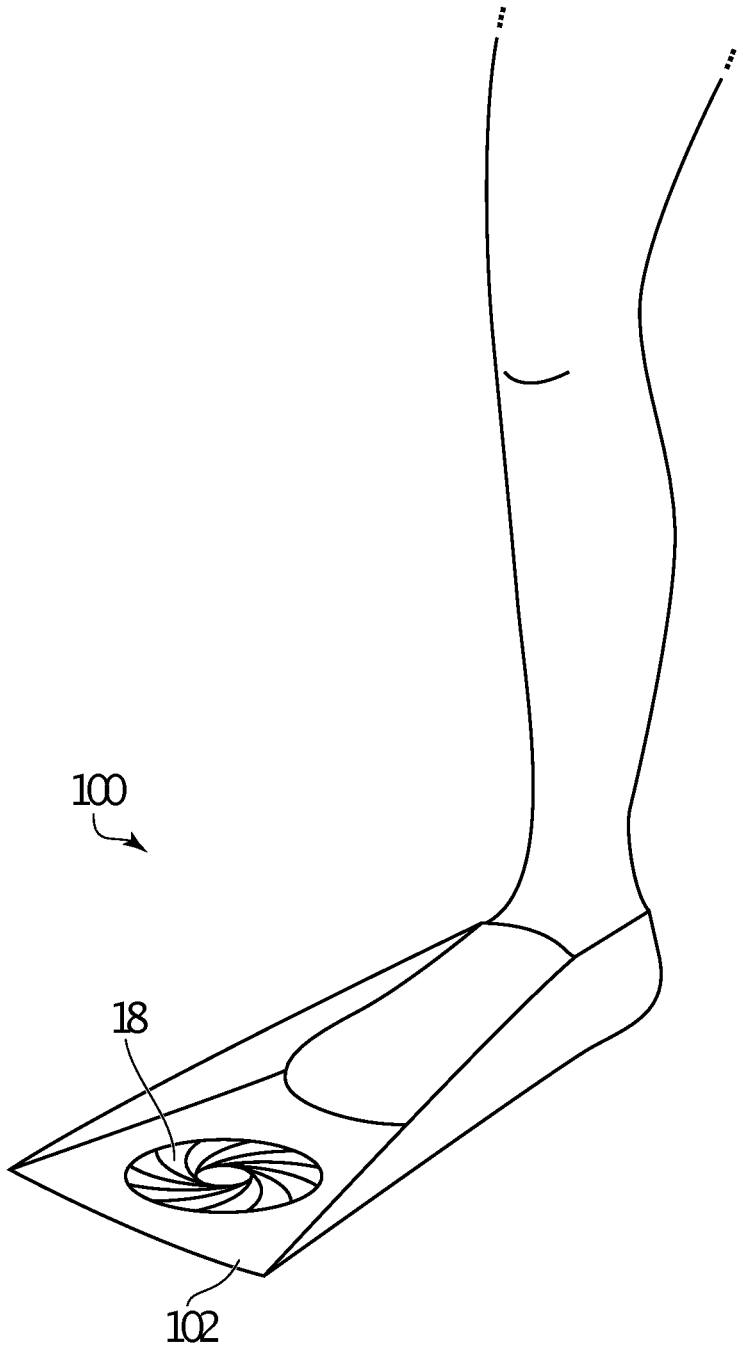
FIG. 12 is a perspective view of an aquatic training aid in accordance with an alternative example.
Figure 13:
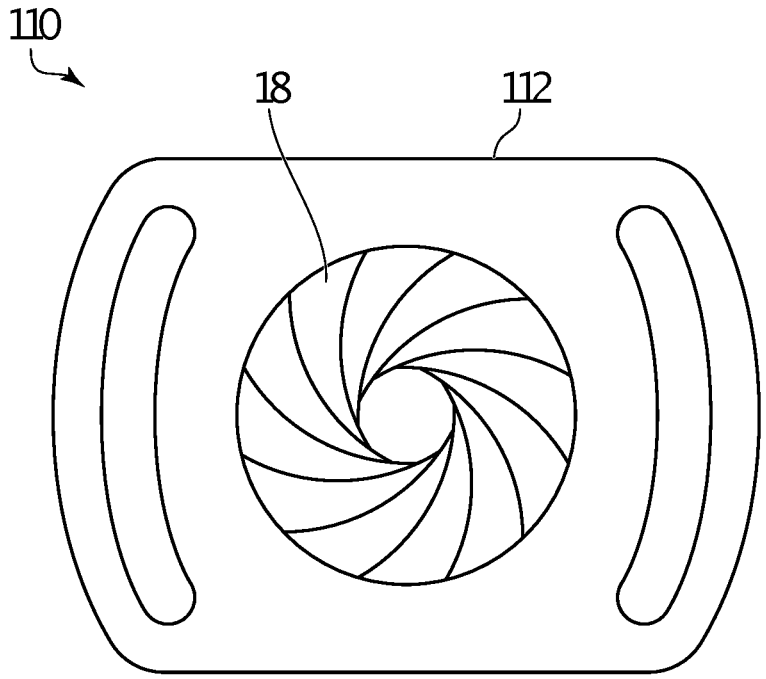
FIG. 13 is a top plan view of an aquatic training aid in accordance with a further alternative example.

According to various examples, the aquatic training aid 10 can be fitted to a snorkel fin (also referred to as flippers) as shown in FIG. 12 or a kickboard as shown in FIG. 13. The aquatic training aid 10 and the variable diaphragm 18 can be applied to any device, tool, or aid in which varying the surface area of the object is desirable.

Figure 14:
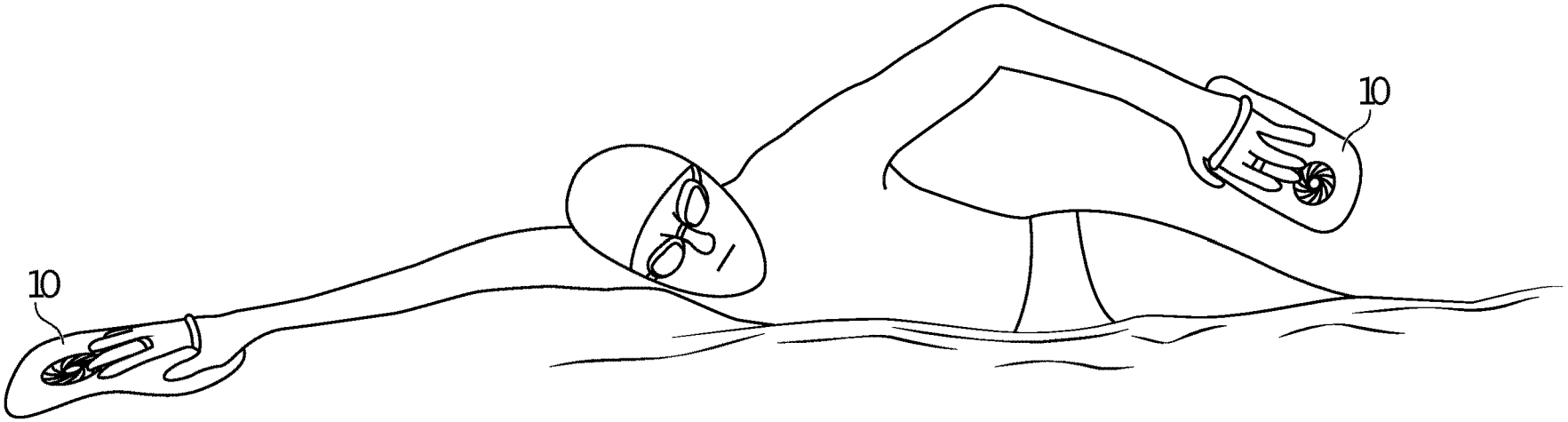
FIG. 14 is a perspective view of two aquatic training aids of FIG. 1 in use when strapped to a swimmer.

FIG. 14 shows a swimmer completing a front stroke and wearing two aquatic training aids 10. In experimental trials of the aquatic training aid 10, it was found that swimmers will oftentimes put their fingers in the aperture of the variable diaphragm 18 to better hold on to the aquatic training aid 10, providing a further advantage to the subject matter of the present specification.

In an alternative example, the aperture in the paddle body 12 can take on other configurations and need not involve a diaphragm construction.

According to this alternative example, structural openings (also referred to as cut-outs) or sliding windows rather than a variable diaphragm 18 could be employed. The hydrodynamic characteristics determined by the size and shape of the structural cut-outs and/or the sliding windows. According to a further alternative example, a paddle body 12 can include one or more combinations of structural cut-outs, sliding windows, and/or one or more variable diaphragms 18.

Advantageously, aquatic training aids 10 of the present specification can provide swimmers with indications of the progress they are making in their training. For example, the speed, resistance or other values measured under use of the aquatic training aid 10 through the water can be tracked. Providing such feedback sensed by a fluid gauge or other sensor in communication with a digital display integral to the aquatic training aid 10 or to a connected smartphone, smartwatch, or other wearable device is intended to be included within the scope of the present specification The following describes an aquatic training aid including a paddle member for wearing by a swimmer, a variable diaphragm disposed within the paddle member, the variable diaphragm comprising a plurality of fitted blades arranged to form an aperture, and a housing peripherally framing the plurality of fitted blades. The variable diaphragm is adjustable to change the aperture from a first expanded position to a second contracted position, and hydrodynamic characteristics of the aquatic training aid when moved through water are affected by the change of the aperture.

In one example, the plurality of fitted blades are maintained in a friction fit within the housing keeping the aperture substantially fixed in shape and size when the paddle member is moved through water. Use of the term substantially means considerably or for the most part.

According to one example, the paddle member includes a curved portion disposed at a top end of the paddle member and a protruding ridge disposed lengthwise along a portion of the paddle member.

The housing of an exemplary aquatic training aid can include a base plate with a plurality of longitudinal slots extending radially defined in the base plate and a blade actuating ring having a plurality of circular slots defined in the blade actuating ring. Each of the plurality of fitted blades includes a first pin positioned at a first surface for sliding engagement with one of the longitudinal slots and a second pin positioned at a second surface for rotating engagement with one of the circular slots. Rotation of the blade actuating ring in a first direction relative to the base plate rotates the plurality of fitted blades about the plurality of second pins in the circular slots and engages the plurality of first pins to move along the plurality of longitudinal slots to change the aperture from the first expanded position to the second contracted position. Rotation of the blade actuating ring in a second direction opposite the first direction changes the aperture from the second contracted position to the first expanded position.

In one example, the blade actuating ring can include an actuator slider to allow rotation of the blade actuating ring by sliding movement of the actuator slider. The housing can include a top plate depicting a legend of aperture sizes positioned along the top plate starting from the first expanded position to the second contracted position. The actuator slider can be aligned with the legend to allow selection of resistance level by sliding movement of the actuator slider.

The variable diaphragm can be removable from the paddle member.

According to one example, the aquatic training aid can include at least one strap made of a tubular string for securing a hand or a finger of the swimmer to the paddle member. The paddle member can include a plurality of recesses that allow at least one end of the at least one strap to be stringed through some of the plurality of recesses.

According to some examples, the paddle member can be a fin with a recess for receiving a foot of the swimmer, or a kick board with at least one grippable handle.

The variable diaphragm can be made of ABS plastic.

In accordance with an alternative example, the aquatic training aid includes a paddle member for wearing by a swimmer, at least one structural opening disposed within the paddle member, the structural opening including a window. The structural opening is adjustable to change the window from a first expanded position to a second contracted position, and hydrodynamic characteristics of the aquatic training aid when moved through water are affected by the change of the window.

Moreover, according to one example, the aquatic training aid can include a paddle member for wearing by a swimmer and at least one strap with a tubular string for securing a hand of the swimmer to the paddle. The paddle member can include a plurality of recesses that allow at least one end of the at least one strap to be stringed through some of the plurality of recesses. The aquatic training aid also includes a variable diaphragm disposed within the paddle member. The variable diaphragm includes a plurality of fitted blades arranged to form an aperture, and a housing peripherally framing the plurality of fitted blades. The plurality of fitted blades are maintained in a friction fit within the housing keeping the aperture substantially fixed in shape and size when the paddle member is moved through water. Upon rotation of the housing, the aperture is changed from a first expanded position to a second contracted position. The hydrodynamic characteristics of the aquatic training aid when moved through water are affected by the change of the aperture providing variable resistance during a swim session.

While a number of exemplary aspects and examples have been discussed above, those of skill in the art will recognize certain modifications, permutations, additions and sub-combinations thereof. The matter set forth in the foregoing description and accompanying drawings is offered by way of illustration only and not as a limitation. The actual scope of the disclosed examples of the present specification is intended to be defined in the following claims when viewed in their proper perspective based on the prior art.

What is claimed is:

1. An aquatic training aid comprising:

a paddle member for wearing by a swimmer;

a variable diaphragm disposed within the paddle member, the variable diaphragm comprising a plurality of fitted blades arranged to form an aperture, and a housing peripherally framing the plurality of fitted blades; and wherein the variable diaphragm is adjustable to change the aperture from a first expanded position to a second contracted position, and hydrodynamic characteristics of the aquatic training aid when moved through water are affected by the change of the aperture.

2. The aquatic training aid of claim 1, wherein the plurality of fitted blades are maintained in a friction fit within the housing keeping the aperture substantially fixed in shape and size when the paddle member is moved through water.

3. The aquatic training aid of claim 1, wherein the paddle member further comprises:

a curved portion disposed at a top end of the paddle member; and a protruding ridge disposed lengthwise along a portion of the paddle member.

4. The aquatic training aid of claim 1, wherein the housing comprises:

a base plate with a plurality of longitudinal slots extending radially defined in the base plate;

a blade actuating ring having a plurality of circular slots defined in the blade actuating ring;

wherein each of the plurality of fitted blades comprises a first pin positioned at a first surface for sliding engagement with one of the longitudinal slots and a second pin positioned at a second surface for rotating engagement with one of the circular slots;

wherein rotation of the blade actuating ring in a first direction relative to the base plate rotates the plurality of fitted blades about the plurality of second pins in the circular slots and engages the plurality of first pins to move along the plurality of longitudinal slots to change the aperture from the first expanded position to the second contracted position; and wherein rotation of the blade actuating ring in a second direction opposite the first direction changes the aperture from the second contracted position to the first expanded position.

5. The aquatic training aid of claim 4, wherein the blade actuating ring comprises an actuator lip to allow rotation of the blade actuating ring by sliding movement of the actuator lip.

6. The aquatic training aid of claim 5, wherein the housing further comprises a top plate depicting a legend of aperture sizes positioned along the top plate starting from the first expanded position to the second contracted position; and wherein the actuator lip is aligned with the legend of aperture sizes to allow selection of resistance level by sliding movement of the actuator lip.

7. The aquatic training aid of claim 1, wherein the variable diaphragm is removable from the paddle member.

8. The aquatic training aid of claim 1, further comprising:

at least one strap comprising a tubular string for securing a hand or a finger of the swimmer to the paddle member; and wherein the paddle member further comprises a plurality of recesses that allow at least one end of the at least one strap to be stringed through some of the plurality of recesses.

9. The aquatic training aid of claim 1, wherein the paddle member is a fin comprising a recess for receiving a foot of the swimmer.

10. The aquatic training aid of claim 1, wherein the paddle member is a kick board comprising at least one grippable handle.

11. The aquatic training aid of claim 1, wherein the variable diaphragm is made of ABS plastic.

12. An aquatic training aid comprising:

a paddle member for wearing by a swimmer;

at least one strap comprising a tubular string for securing a hand of the swimmer to the paddle member wherein the paddle member further comprises a plurality of recesses that allow at least one end of the at least one strap to be stringed through some of the plurality of recesses;

a variable diaphragm disposed within the paddle member, the variable diaphragm comprising a plurality of fitted blades arranged to form an aperture, and a housing peripherally framing the plurality of fitted blades wherein the plurality of fitted blades are maintained in a friction fit within the housing keeping the aperture substantially fixed in shape and size when the paddle member is moved through water; and wherein rotation of the housing changes the aperture from a first expanded position to a second contracted position, and hydrodynamic characteristics of the aquatic training aid when moved through water are affected by the change of the aperture.

* * * * *